United States Patent [19]

Gunder

[11] Patent Number: 4,593,598

[45] Date of Patent: Jun. 10, 1986

[54] CARTRIDGE RESIZING APPARATUS

[76] Inventor: James A. Gunder, 13963 McCurie St., Taylor, Mich.

[21] Appl. No.: 648,296

[22] Filed: Sep. 7, 1984

[51] Int. Cl.[4] ..... F42B 33/10; B21D 51/54; B21K 21/04; B23P 15/22

[52] U.S. Cl. ..... 86/36; 86/23; 86/24; 86/28; 86/37; 29/1.31; 72/352

[58] Field of Search ..... 86/23, 24, 28, 36, 37, 86/38, 39, 40, 41, 26, 27, 24; 29/1.3, 1.31, 1.32; 72/352; 102/464

[56] References Cited

U.S. PATENT DOCUMENTS

| | | | |
|---|---|---|---|
| 2,807,186 | 9/1957 | Veum | 86/23 |
| 3,450,000 | 6/1969 | Ponsness | 86/25 |
| 3,796,127 | 3/1974 | Dietemeyer | 86/30 |
| 4,133,248 | 1/1979 | Phillips | 86/23 |
| 4,133,249 | 1/1979 | Bachhuber et al. | 86/36 |
| 4,188,855 | 2/1980 | Alberts | 86/45 |
| 4,325,282 | 4/1982 | Schaenzer | 86/24 |
| 4,329,906 | 5/1982 | Heers | 86/23 |
| 4,393,744 | 7/1983 | Lee | 86/31 |
| 4,510,842 | 4/1985 | Hlusko | 86/25 |

*Primary Examiner*—Stephen J. Lechert, Jr.
*Assistant Examiner*—Howard J. Locker
*Attorney, Agent, or Firm*—Gifford, Groh, VanOphem, Sheridan, Sprinkle & Dolgorukov

[57] ABSTRACT

An apparatus for resizing rifle cartridge cases comprising the die fixedly positioned with respect to a frame and a ram operated by a lever mechanism adapted to raise a case into a resizing cavity within the die. A punch is loosely supported in the die and includes an extractor pin at one end for removing the primer from the head of the rifle case. The die is covered by a head cap including a threaded stem adapted to abut against the punch. The head cap includes a lateral flange adapted to be engaged by levers for forcing the punch against the head of the case when the case is to be removed from the die. The punch also includes an expansion sleeve for resizing the neck of the cartridge as the case is extracted from the die and an expanded end of the punch loosely suspends the punch within the die when the case has been removed.

12 Claims, 6 Drawing Figures

CARTRIDGE RESIZING APPARATUS

BACKGROUND OF THE INVENTION

I. Field of the Present Invention

The present invention relates generally to metal working devices, and more particularly, to a hand operated press for resizing used rifle bullet casings for reuse.

II. Description of the Prior Art

It is well known that ammunition for rifles and the like can be rather expensive. Moreover, commercially available ammunition may not be as uniformly constructed or provided with the particular load desired by a discriminating marksman. As a result, it is desirable to reuse rifle cartridge cases by replacing the primer, and inserting the desired load and the projectile to the marksman's specifications. Of course, one of the problems of reusing the cases is that the case is deformed by expansion due to the explosion which has occured within the case. Accordingly, it is necessary to resize the case to proper dimensions before the case can be safely reused in a rifle.

Although, there are several previously known apparatus for reloading and resizing shotgun shells, such devices are unrelated to the needs of the rifle marksman. For example, shotgun shells can be resized only after they have been loaded since the load provides the support for the side wall of the shell. As a result, the function and structure of such devices differ substantially from rifle cartridge case resizing apparatus.

A disadvantage of previously known rifle case resizing devices is that once a case has been pressed into the die for reducing the case diameter to the appropriate dimension, the case must be removed from tight engagement within the die. Typically, the case has a head including a radially expanded flange or groove which is often defined by a groove at the end of the case. Thus, the head holder has an annular slot adapted to receive the flange of the head of the case and rigidly support the case for movement into the die. Likewise, the head holder engages the flange for withdrawal of the case from the die. Unfortunately, the head length of the case is a critical dimension, and the application of a force necessary to dislodge the case from the die exerts a substantial amount of pressure against the flange which can deform the flange and thus alter the head length. Engagement of the head flange by a head holder is substantially the only manner used in the prior art to effectively apply sufficient force to the case in order to withdraw the case from tight engagement within the die of the press. As a result, the number of times the case can be resized and reloaded is substantially limited as a practical matter when the previously known resizing devices are used.

SUMMARY OF THE PRESENT INVENTION

The present invention overcomes the above mentioned disadvantages by providing a rifle case resizing apparatus in which a punch is used to eject the spent primer after the case has been urged into the sizing die. In addition, the apparatus includes means for extraction of the case from the die without applying withdrawal pressure solely to the flange on the head of the case. In addition, unlike previously known case reclaiming apparatus, the punch is mounted as a floating punch so that it can center itself within the case and does not impose eccentric pressures upon the case while passing through the case for removal of the spent primer.

In general, the resizing apparatus of the present invention comprises a frame which can be rigidly mounted to a table or the like and a lever operated ram mechanism for displacing the case into and out of a resizing die secured to the head of the frame. The ram is adapted to slidably receive a head holder which is particularly selected for holding the particular case size desired to be reclaimed. In addition, the die is detachably secured to the head of the frame so that it can be easily repositioned or replaced with dies of different sizes for resizing cases of a different head length or calibur.

In the preferred embodiment, the lever mechanism includes lever arms adapted to engage an expanded flange on a head cap which fits over the upper housing portion of the die. The cap includes a threaded stem adapted to abut against the end of the punch so that as the lever arms urge the head cap downwardly, the stem engages the punch and pushes it against the inner head wall of the case to drive the case out of the die without exerting the full extracting force against the head flange engaged in the head holder secured to the ram.

It is to be understood that the threaded stem in the head cap of the preferred embodiment can be backed off from the top of the punch so that the punch can float loosely within the die and is not rigidly oriented with respect to the die. The other end of the punch includes an extractor pin which extends through the primer hole in the head of the case, and the extractor pin is preferably detachably secured to the end of the punch. Another advantage of the punch employed in the resizing apparatus of the present invention is that the punch includes an expansion sleeve over a portion of the punch so that withdrawal of the punch from the case expands the neck of the case to a particular dimension which is required to fit a projectile in the neck of the case.

Thus, the present invention provides a resizing apparatus for rifle cases which resizes the case and removes the spent primer from the head of the case. In addition, the neck of the case is resized for receipt of the new projectile in the case. In addition, the punch also serves to eject the case from within the die after it has been wedged into the die by the ram so that full extraction pressure is not applied to the head flange of the case. As a result, the apparatus avoids deformation of the head flange and alteration of the head length. These and other advantages of the present invention will be clearly understood by reference to the following detailed description.

BRIEF DESCRIPTION OF THE DRAWING

The present invention will be more clearly understood by reference to the following detailed description of a preferred embodiment of the present invention when read in conjunction with the accompanying drawing in which like reference characters refer to like parts throughout the view and in which.

DETAILED DESCRIPTION OF A PREFERRED EMBODIMENT OF THE PRESENT INVENTION

Figure 1:
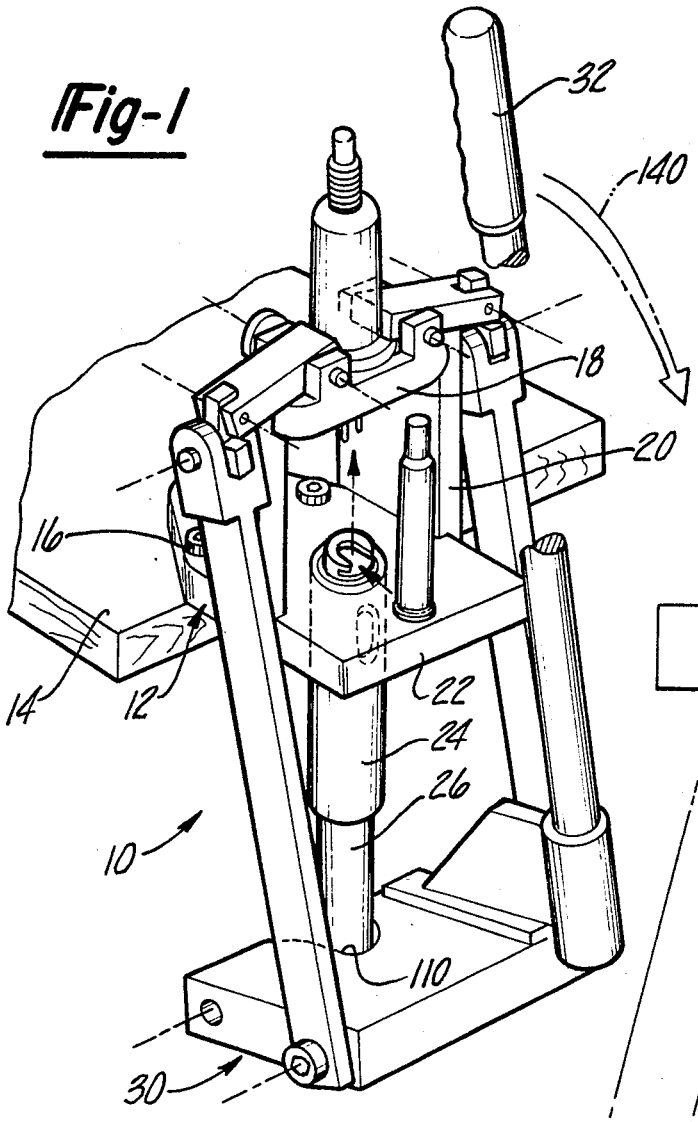
FIG. 1 is a perspective view of a case resizing apparatus according to the present invention.
Figure 1:
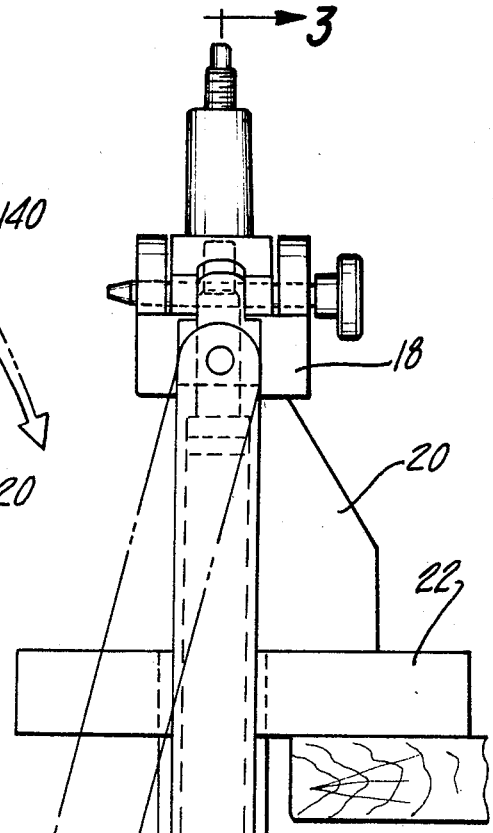

Referring first to FIG. 1, the resizing apparatus 10 according to the present invention is thereshown comprising a frame 12 secured to a table top 14 by appropriate means such as mounting bolts 16. The frame 12 includes a head 18, side stanchions 20, and a base 22. The base 22 includes an aperture adapted to receive the tubular guide housing 24 through which a ram 26 is slidably received. A lever mechanism 30 is pivotally connected to the lower end of the ram 26 and includes a lever handle 32 for manually urging the ram toward and away from the head 18 of the frame in a manner to be described in greater detail hereinafter.

Figure 3:
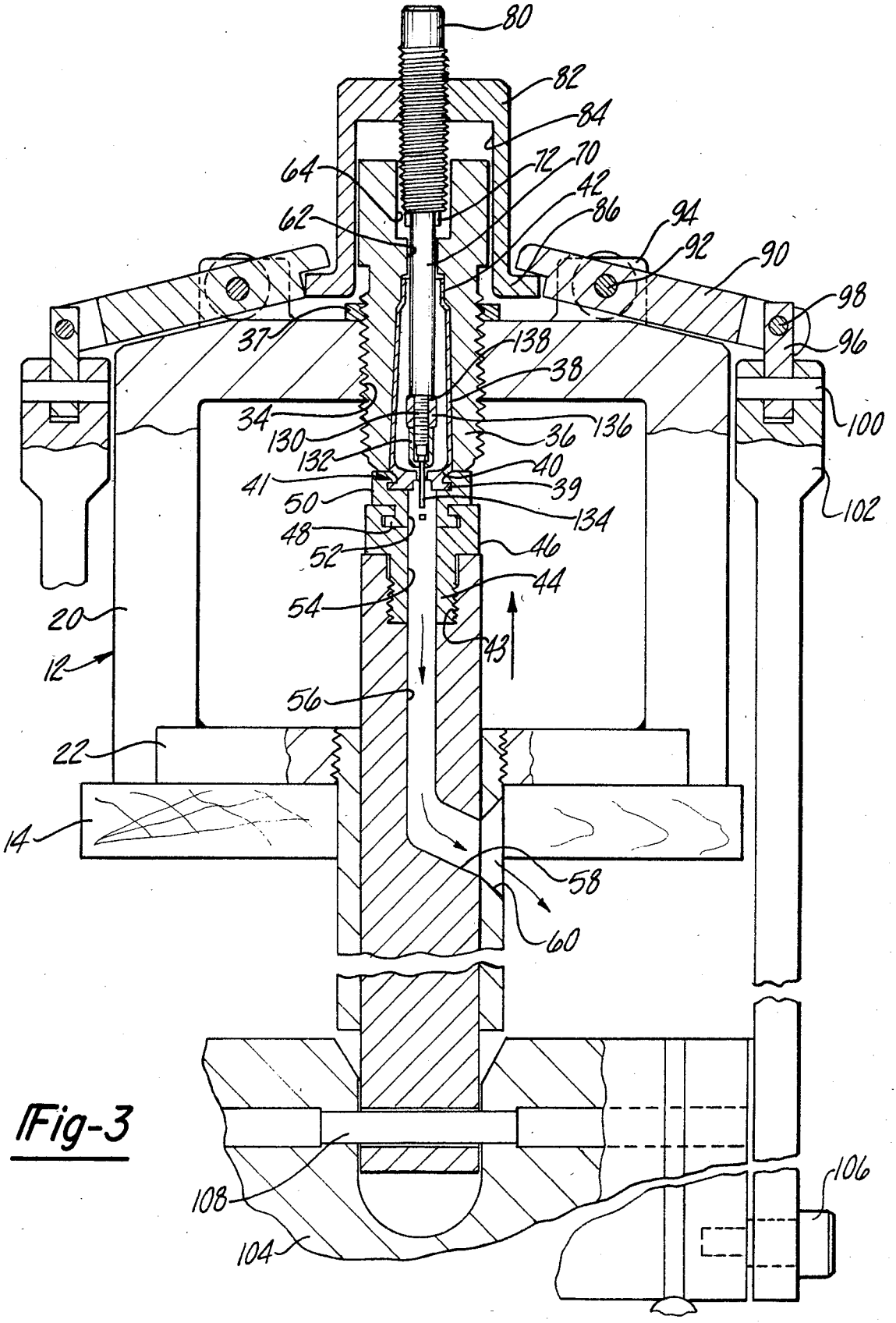
FIG. 3 is a sectional view taken substantially along the line 3—3 in FIG. 2.

Referring now to FIG. 3, the head 18 includes a threaded aperture 34 axially aligned with the tubular housing 24 which is adapted to receive the exteriorly threaded body of a die housing 36. The die housing 36 includes an elongated cavity 38 particularly dimensioned to press against the outside of the case 40 so that the expanded casing is pressed to a predetermined size when the case 40 is fully inserted into the cavity 38. Of course, the lower portion of the cavity 38 can be tapered so that the die housing 36 gradually decreases the size of the casing 40.

The ram 26 includes an axial threaded bore 43 in its upper end adapted to receive the threaded stem 44 of a head holder base 46. The head holder base 46 is in turn adapted to slidably receive the attachment flange 48 of head holder 50. The head holder 50 includes an annular slot (see FIG. 1) adapted to receive the radially expanded flange 39 at the head 41 of the casing.

The head holder 50 and the head holder base 46 include axial apertures 52 and 54, respectively, communicating with an axial bore 56 in the ram 26 through which a spent, ejected primer can descend toward an outlet opening 58 in the ram. When the ram is in its fully raised position, the opening 58 communicates with an opening 60 in the housing 24 so that the spent primer ejected from the casing 40 can be discharged.

The die housing 36 also includes bore 62 above the cavity 38 adapted to receive a punch 70 therethrough. The bore 62 includes a radially enlarged portion 64 adapted to receive an enlarged body portion 72 of the punch 70 and a threaded stem 80 adjustably engaged within a head cap 82. The head cap 82 includes a hollow chamber 84 adapted to receive the top of the die housing 36 therein so that the cap 82 can be placed over the die housing 36. In addition, the lower edge of the head cap 82 includes radially expanded flange 86. The radially expanded flange 86 is aligned for engagement with the ends of a pair of lever arm 90 which are pivotally mounted by pivot pins 92 extending through pivot journal members 94 secured to the head 18 of the frame 12. The other end of each lever arm 90 extends outwardly beyond a stanchion 20 for pivotal connection to connecting element 96 by a pivot pin 98. Each connecting element 96 is secured by a pivot pin 100 extending transversely to the pivot pin 98 to a lever arm 102. The other end of each lever arm 102 is pivotally secured to the lever means 30 for actuating the ram 26.

Figure 2:
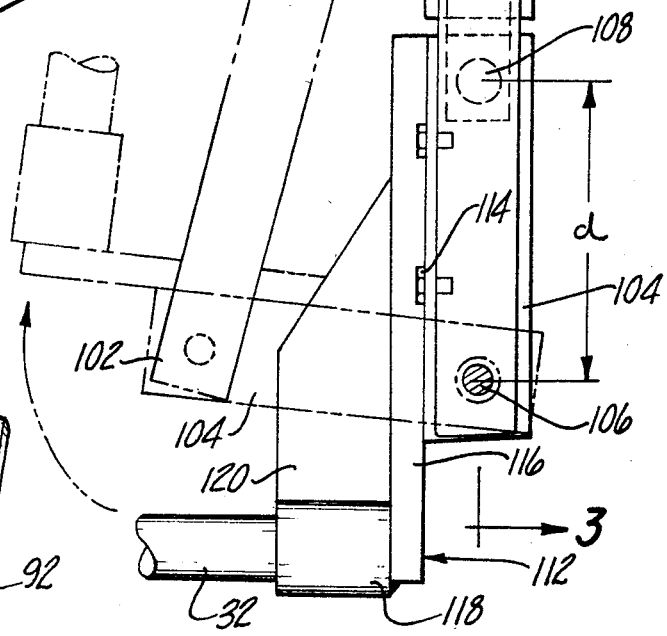
FIG. 2 is a side plan view of the device shown in FIG. 1.

As best shown in FIG. 2, the lower end of each lever arm 102 is pivotally secured with respect to one end of the lever plate 104 by a pivot pin 106 mounted to the plate 104 and extending through an aperture in the end of the arm 102. Such a connection is made on each side of the plate 104 for each arm 102. At the other end of the plate 104, the plate 104 supports a pivot pin 108 extending parallel to the pivot pins 106 across an opening 110. The pin 108 is pivotally received through an aperture in the lower end of ram 26.

A handle connecting bracket 112 is secured to the top surface of the lever plate 104 by bolts 114 or the like. The bracket 112 includes a base plate 116, a handle receiving sleeve 118 and a support gusset 120 between the base 116 and the sleeve 118. The elongated handle rod 32 is secured within the sleeve 118 by appropriate means such as welds or the like.

Referring again to FIG. 3, the lower end of the plate 70 includes a threaded end 130 adapted to receive a tubular, internally threaded sleeve 132 thereon. The sleeve 132 includes a reduced diameter aperture at one end through which the body of an extraction pin 134 can extend while an enlarged head of the pin remains entrained within the sleeve 132. The extraction pin 134 is inserted into the sleeve 132 so that the enlarged head is positioned against the end of the punch 70 when the sleeve 132 is threadably engaged on the threaded end 130 of the punch 70. In addition, the punch includes a radially expanded sleeve 136 entrained between an abutment surface 138 on the punch and an end of the sleeve 132.

Having thus described the important structural features of the present invention, the operation of the device can be readily described. It will be readily understood that the die housing 36 and the head holder 50 will be chosen in correspondence with a particular calibur of rifle cartridge case to be resized in a particular operation. In addition, the height of the die housing 36 with respect to the frame is adjusted so that when the punch has been raised to its highest point, the case 40 is fully received within the cavity 38 for appropriate sizing of the entire case. The height of the sizing die 36 can be adjusted by rotating the die housing 36 within the aperture 34, and the die housing 36 can be fixedly retained in position by means of a lock nut 37 as shown in FIG. 3.

Operation of the resizing apparatus is initiated with the lever 32 in a raised position as shown in FIG. 1 or as shown in phantom line in FIG. 2 so that the ram 26 is in its lower position. Nevertheless, in that position, the head holder 50 is positioned above the base 22 so that head flange 39 can be slid into the slot of the head holder 50. The punch 70 is supported in the die housing 36 by the enlarged head portion 72 resting against the bottom of the enlarged bore portion 64. The head cap 82 lies loosely over the top of the die housing 36 and the stem 80 is spaced apart from the upper end of the punch 70. The flange 86 extends below the ends of the lever arms 90.

As the lever 32 is moved in the direction of arrow 140 as shown in FIG. 1, the lever plate 104 pivots about the pivot pin 106, whereby the other end of the lever plate 104 and the pivot pin 108 installed therein are raised upwardly toward the position shown in solid line in FIG. 2. During this movement, the punch 70 engages the neck of the case 40 while the case 40 is driven upwardly and into the cavity 38 of the die housing 36. As a result, the case is compressed to a predetermined size by the peripheral wall of the die cavity 38.

When the case 40 reaches the top of the cavity 38, the extractor pin 134 extends through an aperture at the head end of the case and removes the spent primer (not shown) from its cavity in the head of the case 40. The primer is then free to fall through the connected bores 52, 54 and 56, and then through the discharge outlet formed by the apertures 58 and 60. The end of the sleeve 132 on punch 70 is pressed against the bottom i.e. head wall, of the case 40 so that when the case is fully inserted within cavity 38, the enlarged end 72 of punch 70 is lifted above the bottom of the bore portion 64. (See FIG. 3) Preferably the stem 80 is adjusted so that the head cap flange 86 abuts against the raised ends of the lever arms 90 when the case 40 is fully inserted into die cavity 38.

Figure 4:
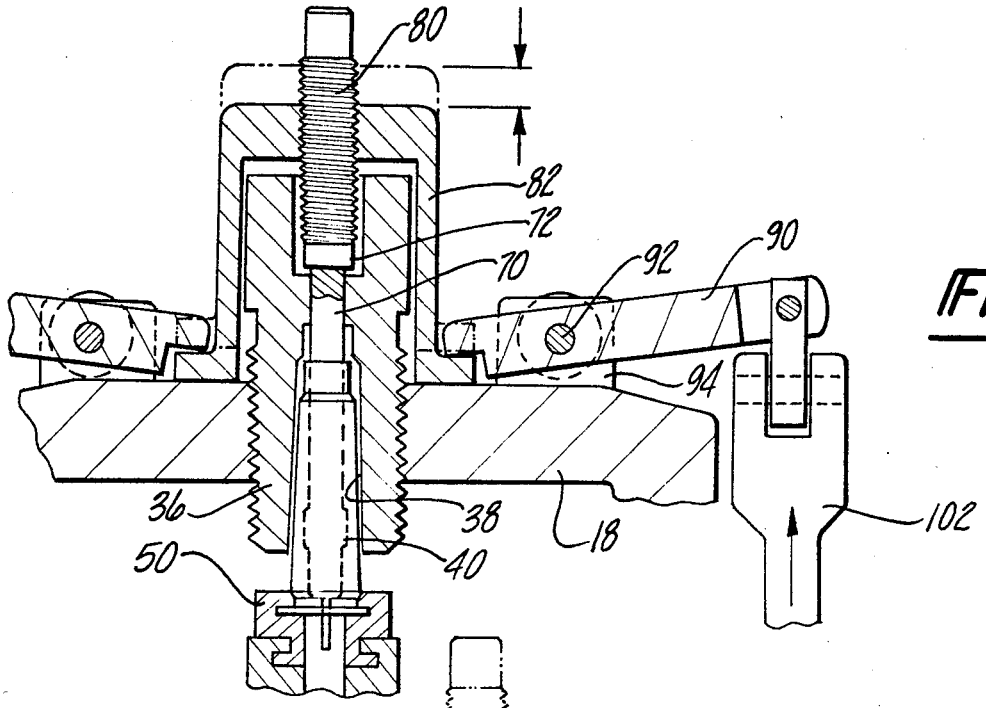
FIG. 4 is a fragmentary sectional view showing a portion of the device illustrated in FIG. 3 but in a different operational position.

Once the case has been fully inserted into the cavity 38 in the die housing 36, it has been resized and is ready for removal from the resizing apparatus. Thus the handle 32 is then moved from the position shown in solid line in FIG. 2 to the position shown in phantom line in FIG. 2. Since the case 40 wedged within the die housing 36, and the case is positively connected to the ram 26 by the headholder 50, intitiation of movement of the handle 32 from the position shown in solid line in FIG. 2 causes the lever plate 104 to pivot about the pivot pin 108, whereby the other end of the plate 104 and thus pivot pin 106 is displaced slightly upward. Such displacement of the pivot pin 106 raises the pivot arms 102 and the connecting members 96 so that the lever arms 90 pivot about the pivot pins 92. Thus the ends of the pivot arms 90 are depressed downwardly against the flange 86 of the head cap 82. As a result, the threaded stem 80 is pressed against the end 72 of the punch 70 while the end of the sleeve 132 at the outer end of the punch is pressed against the bottom or head wall of the case 40. As a result, the punch begins to push the case 40 from the cavity 38 in the die housing 36. Of course, once removal of the case 40 from the cavity 38 has been initiated, the headholder 50 at the end of the ram 26 begins downward movement toward the starting position shown in FIG. 1. Since extraction of the case becomes easier once the case has been displaced from the fully inserted position due to the tapering walls of the die housing cavity 38, only a small movement of head cap 82 and thus the punch 70 is necessary to initially disengage the case 40 from the die housing 36 as shown at D in FIG. 4. Nevertheless, it will be understood that the case 40 remains secured to the head holder 50 and thus continues to be extracted from the die housing 36 by movement of the ram 26.

In addition, it will be understood that as the case is extracted from the cavity 38, the punch is retained within the die housing 36 by the enlarged head 72. As the enlarged sleeve 136 passes through the neck 42, it resizes the neck 42 to an appropriate dimension so that the case is adapted to receive another projectile when the case is reloaded. With the ram 26 again at its lowermost position, the resized case 40 is removed from the head holder 50 and replaced with another case.

Figure 5:
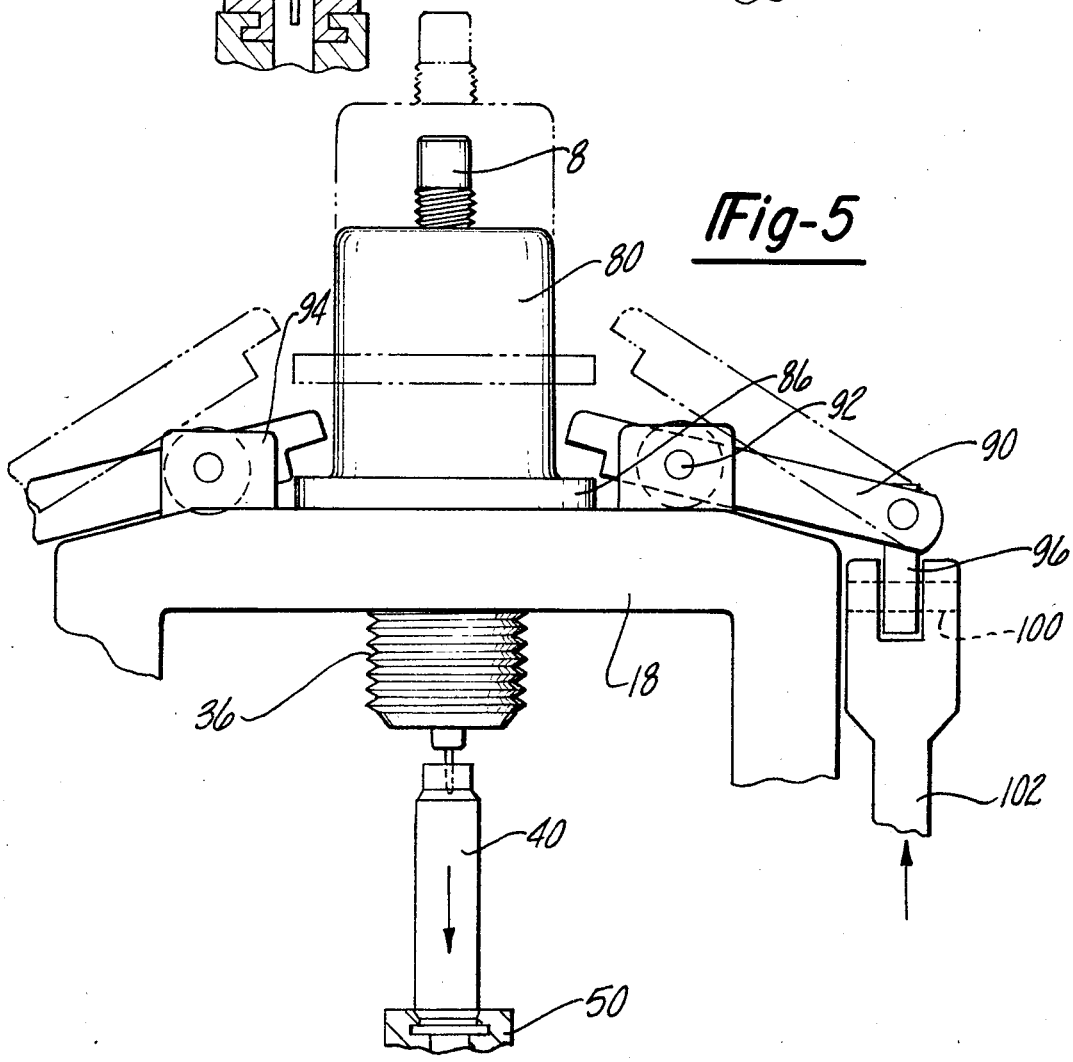
FIG. 5 is a fragmentary front view of a portion of the device shown in FIGS. 1–4.

Moreover, although the head cap 82 is normally loosely entrained over the die housing 36 on the head 18, by the lever arms 90, each pivot pin 92 is easily, slidably retracted from the journal members 94 and the pivot arm 92 so that the head cap can be removed and the die housing 36 can be replaced or adjusted as desired. An especially advantageous means for removing the head cap 82 comprises the removal of one of the pivot pins 92, which is slid from registering apertures in the journal members 94 and the pivot arm 90. Then, the pin 92 is inserted into the registering apertures 58 and 60 in the ram 26 and tubular housing 24, respectively. As a result, the weight of the lever mechanism 30 is substantially supported while the lever arms 90 move to a raised position shown in phantom line in FIG. 5, whereby the head cap 82 is easily lifted from the die housing 36 to provide access to the die housing 36 and the punch 70 therein.

Having thus described my invention, many modifications thereto will become apparent to those skilled in the art to which it pertains without departing from the scope and spirit of the present invention as defined in the appended claims.

What is claimed is:

1. An apparatus for resizing rifle bullet casings having a flanged head and a tubular case, said apparatus comprising:

a frame including a head, a base and means for fixedly positioning said head with respect to said base;

a ram;

lever means for displacing said ram with respect to said frame between said frame base and said frame head;

means for fixedly and removably retaining the flanged head of said rifle casing on the end of said ram, said means being interchangably removed from the end of said ram in order to accommodate casing heads of different sizes;

a sizing die having a sizing cavity which closely conforms to the configuration of the rifle case;

means for removably and adjustably securing said sizing die to said frame head in alignment with said ram;

a sizing punch adapted to be received through the neck of said rifle case, said punch including an extractor pin at one end for extracting the primer of said casing head, abutment means for engaging the head wall of the casing and means for radially expanding the neck of said casing to a predetermined size;

means for supporting said punch within said sizing die wherein said punch extends into said rifle case as said casing is inserted within said sizing cavity;

means for displacing said punch downwardly with respect to said sizing die wherein said abutment means engages said head wall of the casing in order to initiate extraction of said casing from said die; and lever means for displacing said ram with respect to said sizing die between a first position in which said retaining means on said ram positions the casing where the case is spaced apart from said sizing die and a second position in which the case is inserted within said sizing cavity of said die and said sizing punch extends into said case.

2. The invention as defined in claim 1 wherein said means for displacing said punch comprises means for automatically displacing said punch as said lever means is actuated for displacing said ram from said second position toward said first position.

3. The invention as defined in claim 1 wherein said means for radially expanding the neck of said casing comprises an expansion sleeve mounted to said punch wherein said sleeve is radially larger than the periphery of said punch.

4. The invention as defined in claim 1 wherein said means for supporting said punch in said die comprises means for loosely suspending said punch in said die.

5. The invention as defined in claim 4 wherein said means for suspending comprises said die having a bore above said sizing cavity adapted to receive said punch, and wherein said punch includes an enlarged head portion larger than said bore.

6. The invention as defined in claim 1 wherein said means for displacing said punch comprises a cap housing adapted to be received over said die having means for abutting against an end of said punch.

7. The invention as defined in claim 6 wherein said means includes a threaded aperture in said cap and further comprising a threaded stem adapted to be received in said aperture.

8. The invention as defined in claim 6 wherein said cap includes a radially expanded flange, and further comprising means for engaging and displacing said flange as said lever means is actuated for displacing said ram from said second position toward said first position.

9. The invention as defined in claim 8 wherein said means for engaging and displacing said flange comprises second lever means for displacing said flange downwardly.

10. The invention as defined in claim 1 wherein said sizing die includes a peripheral wall about said sizing cavity and wherein at least a portion of said peripheral wall tapers outwardly toward the bottom of said die.

11. The invention as defined in claim 1 wherein said lever means comprises a lever plate, first means for pivotally securing one end of said lever plate to said ram, means for supporting the other end of said plate with respect to said frame including at least one first lever arm and second means for pivotally securing said plate to one end of said at least one lever arm at the other end of said plate, and handle means for manually pivoting said plate about one of said first and second means for pivotally securing said plate.

12. The invention as defined in claim 11 and further comprising means for securing the other end of said at least one first lever arm to said frame, said means for securing comprising at least one second lever arm, means for pivotally securing said second lever arm intermediate its ends to said head of said frame, and means for pivotally connecting an end of said at least one second arm to an end of said at least one first lever.

* * * * *

UNITED STATES PATENT AND TRADEMARK OFFICE

CERTIFICATE OF CORRECTION

PATENT NO. : 4,593,598

DATED : June 10, 1986

INVENTOR(S) : James A. Gunder

It is certified that error appears in the above-identified patent and that said Letters Patent are hereby corrected as shown below:

Column 1, line 9, delete "casings" and insert --cases--;

line 41, after "rigidly" insert --to--.

Column 2, line 14, delete "calibur" and insert --caliber--;

line 62, delete "view" and insert --several views--.

Column 3, line 3, delete "and"' line 5, delete "." and insert --; and--;

lines 6-9, delete "showing insertion of pivot pin into apertures for removal of head cap for replacement or adjustment of the die housing" and insert --of a preferred embodiment whereby a pivot pin is inserted into the apertures to aid removal of the head cap and replacement or adjustment of the die housing or punch--;

line 30, delete "casing" and insert --case--;

UNITED STATES PATENT AND TRADEMARK OFFICE

CERTIFICATE OF CORRECTION

PATENT NO. : 4,593,598

DATED : June 10, 1986

INVENTOR(S) : James A. Gunder

It is certified that error appears in the above-identified patent and that said Letters Patent are hereby corrected as shown below:

Column 3, line 34, delete "casing" and insert --case--;

line 41, delete "casing" and insert --case--;

line 49, delete "casing" and insert --case--.

Column 4, line 20, delete "plate" and insert --punch--;

line 39, delete "calibur" and insert --caliber--;

line 42, delete "punch" and insert --ram 26--.

Column 5, line 15, after "Preferably" insert --,--;

Column 5, line 21, after "thus" insert --,--;

line 24, after "40" insert --is--;

line 29, delete "and thus" and insert --containing--;

line 33, after "Thus" insert --,--;

line 50, delete "at D";

line 67, delete "pivot arm 92" and insert --lever arm 90--.

UNITED STATES PATENT AND TRADEMARK OFFICE

CERTIFICATE OF CORRECTION

PATENT NO. : 4,593,598

DATED : June 10, 1986

INVENTOR(S) : James A. Gunder

Figure 6:
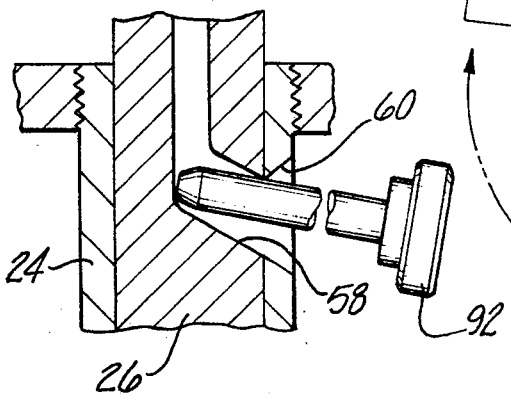
FIG. 6 is a fragmentary view showing insertion of pivot pin into apertures for removal of head cap for replacement or adjustment of the die housing.

It is certified that error appears in the above-identified patent and that said Letters Patent are hereby corrected as shown below:

Column 6, line 4, delete "pivot" and insert --lever--;

line 4, after "Then" insert --as shown in FIG. 6--;

line 20, claim 1, delete "casings" and insert --case--;

line 21, claim 1, delete "casing" and insert --body--;

line 30, claim 1, delete "casing" and insert --case--;

line 33, claim 1, delete "casing" and insert --case--;

line 42, claim 1, delete "casing" and insert --case--;

line 43, claim 1, delete "casing" and insert --case--;

UNITED STATES PATENT AND TRADEMARK OFFICE

CERTIFICATE OF CORRECTION

PATENT NO. : 4,593,598
DATED : June 10, 1986
INVENTOR(S) : James A. Gunder

It is certified that error appears in the above-identified patent and that said Letters Patent are hereby corrected as shown below:

Column 6, line 44, claim 1, delete "casing" and insert --case--;

line 48, claim 1, delete "casing" and insert --case--;

line 51, claim 1, delete "casing" and insert --case--;

line 52, claim 1, delete "casing" and insert --case--;

line 56, claim 1, delete "casing" and insert --case--;

line 67, claim 3, delete "casing" and insert --case--.

Column 7, line 17, claim 7, after "said" insert --abutting--;

line 17, claim 7, after "cap" insert --housing--;

UNITED STATES PATENT AND TRADEMARK OFFICE

CERTIFICATE OF CORRECTION

PATENT NO. : 4,593,598
DATED : June 10, 1986
INVENTOR(S) : James A. Gunder

It is certified that error appears in the above-identified patent and that said Letters Patent are hereby corrected as shown below:

Column 7, line 22, claim 8, after "cap" insert --housing--.

Signed and Sealed this

Ninth Day of December, 1986

*Attest:*

DONALD J. QUIGG

*Attesting Officer*

*Commissioner of Patents and Trademarks*